US005257696A

United States Patent [19]

Greene

[11] Patent Number: 5,257,696

[45] Date of Patent: Nov. 2, 1993

[54] MIRRORED LIPSTICK CONTAINER

[76] Inventor: Karen J. Greene, 3206 Richardson Pl. Rd. Apt. #2, Arnold, Mo. 63010

[21] Appl. No.: 913,206

[22] Filed: Jul. 15, 1992

[51] Int. Cl.[5] ..... B65D 85/72; A45D 42/02

[52] U.S. Cl. ..... 206/385; 206/235; 132/304; 132/316

[58] Field of Search ..... 132/296, 301, 304, 316, 132/317, 318, 320; 206/235, 385, 581; 401/78, 195

[56] References Cited

U.S. PATENT DOCUMENTS

| | | | |
|---|---|---|---|
| 1,490,845 | 4/1924 | Music | 206/385 X |
| 1,655,452 | 1/1928 | Ament | 132/316 X |
| 2,049,378 | 7/1936 | Holl | 206/385 X |
| 2,094,006 | 9/1937 | O'Moore-Farrell | 206/581 X |
| 2,121,221 | 6/1938 | Fontan | 206/385 X |
| 2,294,212 | 8/1942 | Scharff | 132/316 |
| 2,309,544 | 1/1943 | Scharff | 132/316 |
| 2,458,020 | 1/1949 | Olsen | 206/385 X |
| 2,459,733 | 1/1949 | Macy | 132/318 X |
| 2,650,597 | 9/1953 | Girard | 206/385 X |
| 2,751,914 | 6/1956 | Katz | 132/318 X |
| 2,805,674 | 9/1957 | Dulberg | 132/316 |
| 2,951,584 | 9/1960 | Bauer | 132/316 X |
| 4,984,919 | 1/1991 | Hultgren | 401/78 |

FOREIGN PATENT DOCUMENTS

| | | | |
|---|---|---|---|
| 1168586 | 12/1958 | France | 132/316 |
| 0223436 | 8/1943 | Switzerland | 132/318 |

*Primary Examiner*—Bryon P. Gehman
*Attorney, Agent, or Firm*—Leon Gilden

[57] ABSTRACT

A lipstick container includes a lipstick tube having a cover, with the cover including a lid arranged for selective exposure of a mirrored surface below the lid. The invention is further arranged to include at least one mirrored member mounted longitudinally to the exterior surface of the cover. A modification of the invention includes the cover tube side wall mirror having further mirror members hingedly mounted thereto for enhanced viewing during lipstick application.

4 Claims, 4 Drawing Sheets

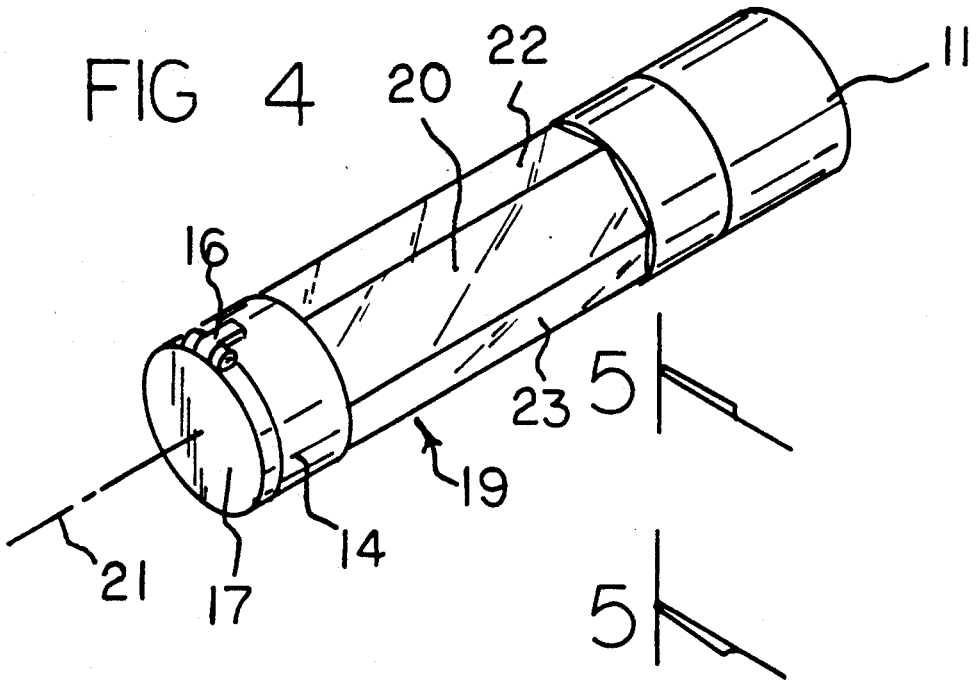
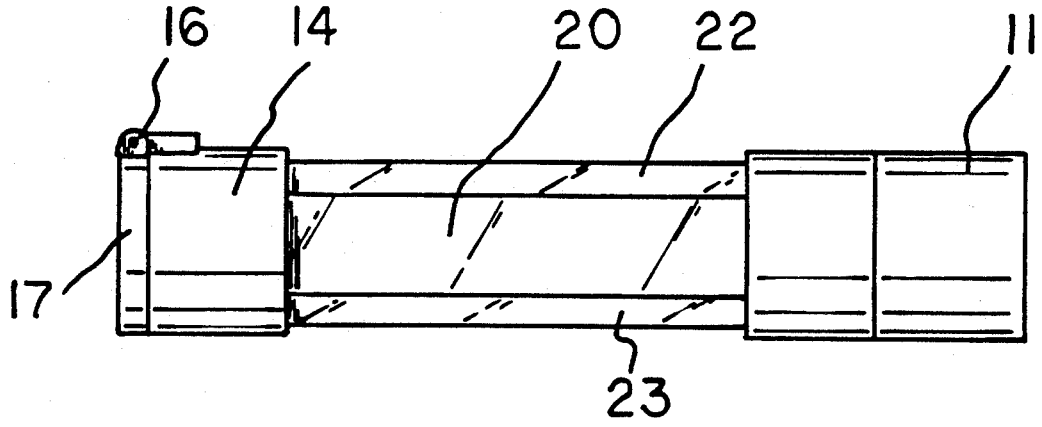
FIG 5

FIG 8
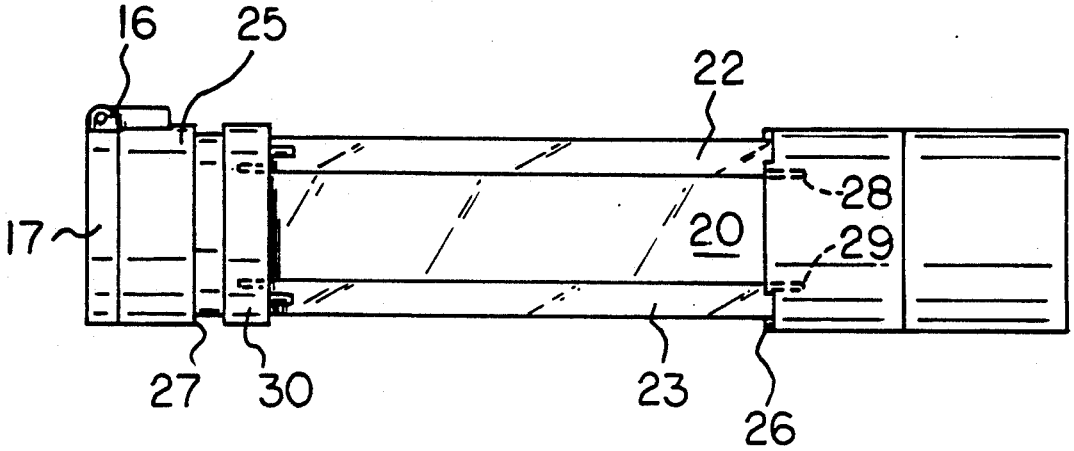
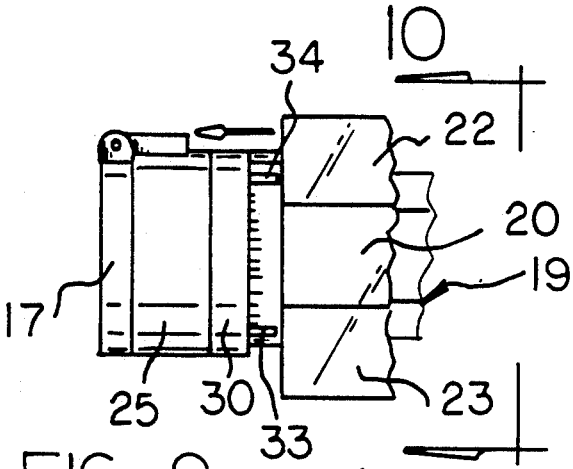
FIG 9
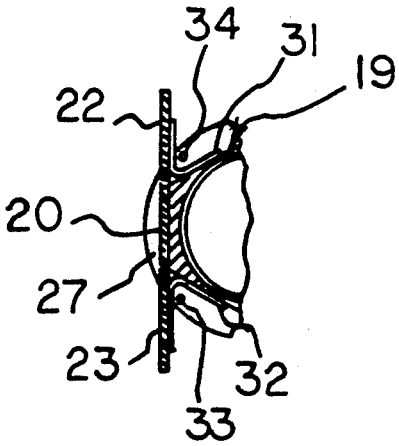
FIG 10

MIRRORED LIPSTICK CONTAINER

BACKGROUND OF THE INVENTION

1. Field of the Invention

The field of invention relates to lipstick container structure, and more particularly pertains to a new and improved mirrored lipstick container wherein the same is arranged to permit visual observation of an individual during lipstick application.

2. Description of the prior Art

Lipstick containers of various types have been utilized throughout the prior art to provide for the directing of a lipstick relative to a holder structure such as exemplified in the U.S. Pat. Nos. 3,954,114; 4,888,667; and 4,984,919.

U.S. Pat. No. 4,905,128 sets forth a container structure having a lipstick tube removably mounted relative to a housing, with the container structure including a mirrored surface for lipstick application.

Accordingly, it may be appreciated there continues to be a need for a new and improved mirrored lipstick container as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of lipstick container apparatus now present in the prior art, the present invention provides a mirrored lipstick container wherein the same is arranged to provide for a mirrored surface to enhance ease of lipstick application. As such, the general purpose of the present invention, which will be described subsequently in greater detail, is to provide a new and improved mirrored lipstick container which has all the advantages of the prior art lipstick container structure and none of the disadvantages.

To attain this, the present invention provides a lipstick container including a lipstick tube having a cover, with the cover including a lid arranged for selective exposure of a mirrored surface below the lid. The invention is further arranged to include at least one mirrored member mounted longitudinally to the exterior surface of the cover. A modification of the invention includes the cover tube side wall mirror having further mirror members hingedly mounted thereto for enhance viewing during lipstick application.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mirrored lipstick container which has all the advantages of the prior art lipstick container structure and none of the disadvantages.

It is another object of the present invention to provide a new and improved mirrored lipstick container which may be easily and efficiently manufactured and marketed.

It is a further object of the present invention to provide a new and improved mirrored lipstick container which is of a durable and reliable construction.

An even further object of the present invention is to provide a new and improved mirrored lipstick container which is susceptible of a low cost of manufacture with regard to both materials and labor, and which accordingly is then susceptible of low prices of sale to the consuming public, thereby making such mirrored lipstick containers economically available to the buying public.

Still yet another object of the present invention is to provide a new and improved mirrored lipstick container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of a modified aspect of the invention.

FIG. 5 is an orthographic view, taken along the lines 5—5 of FIG. 4 in the direction indicated by the arrows.

FIG. 8 is an orthographic side view of the invention including a slide ring structure.

FIG. 9 is an enlarged orthographic view of the slide ring structure in a retracted orientation relative to the mirror structure.

FIG. 10 is an orthographic view, taken along the lines 10—10 of FIG. 9 in the direction indicated by the arrows.

DESCRIPTION OF THE PREFERRED EMBODIMENT

Figure 1:
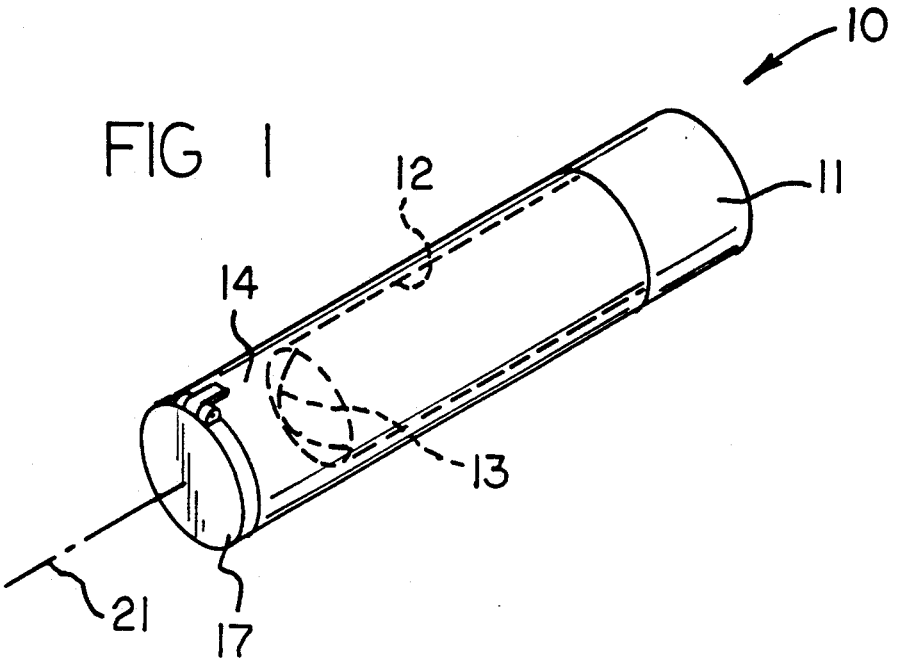
FIG. 1 is an isometric illustration of the instant invention.
Figure 2:
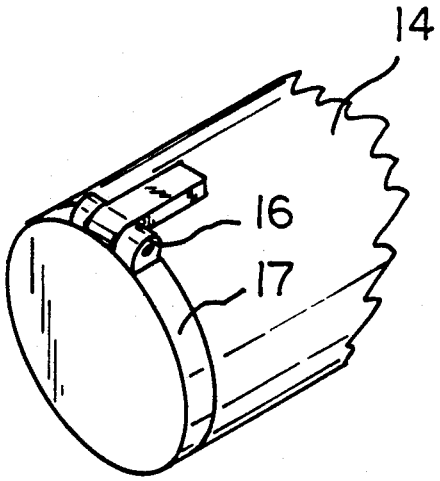
FIG. 2 is an enlarged isometric end view of the container structure of the invention.
Figure 3:
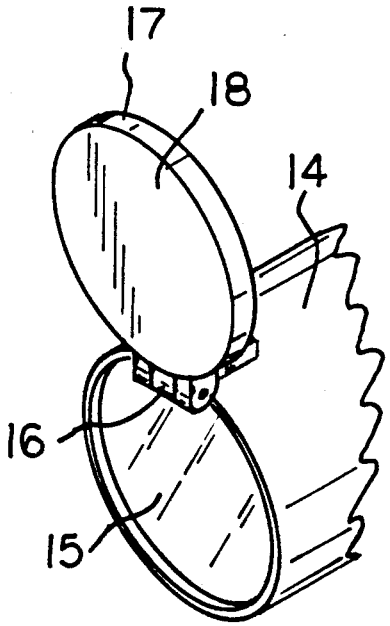
FIG. 3 is an isometric illustration of the container structure illustrating the lid in an elevated orientation to provide for exposure of the associated mirror structure.

With reference now to the drawings, and in particular to FIGS. 1 to 10 thereof, a new and improved mirrored lipstick container embodying the principles and concepts of the present invention and generally designated by the reference numeral 10 will be described.

More specifically, the mirrored lipstick container 10 of the instant invention essentially comprises a cylindrical base housing 11 mounting a base housing extension tube 12 containing a lipstick tube 13 therewithin, typically extensible and retractable relative to the extension tube 12, in a manner known in the prior art and typified by various prior art patents such as exemplified in U.S. Pat. No. 4,984,919 incorporated herein by reference.

A cover tube 14 coaxially aligned with the base housing 11 and the extension tube 12 is arranged for selective securement to the base housing 11, with the cover tube 14 having a mirrored end wall 15. The mirrored end wall includes a lid 17 having a spring hinge 16, with the lid 17 normally biased over the end wall 15, with the lid including a lid mirror 18 typically formed of a convex configuration for exaggeration purposes and of application of lipstick for cooperation with the mirrored end wall 15.

The FIGS. 4 and 5 illustrate the use of the cover tube 14 having an elongate central cover tube polygonal body portion 19 coaxially aligned along the axis 21 of the cover tube 14. The polygonal body portion 19 includes a first mirror plate 20 arranged coextensively of the polygonal body portion along a planar wall thereof cooperative with respective second and third mirror plates 22 and 23 coextensive with the first mirror plate 20 positioned on respective first and second sides of the first mirror plate 20.

Figure 6:
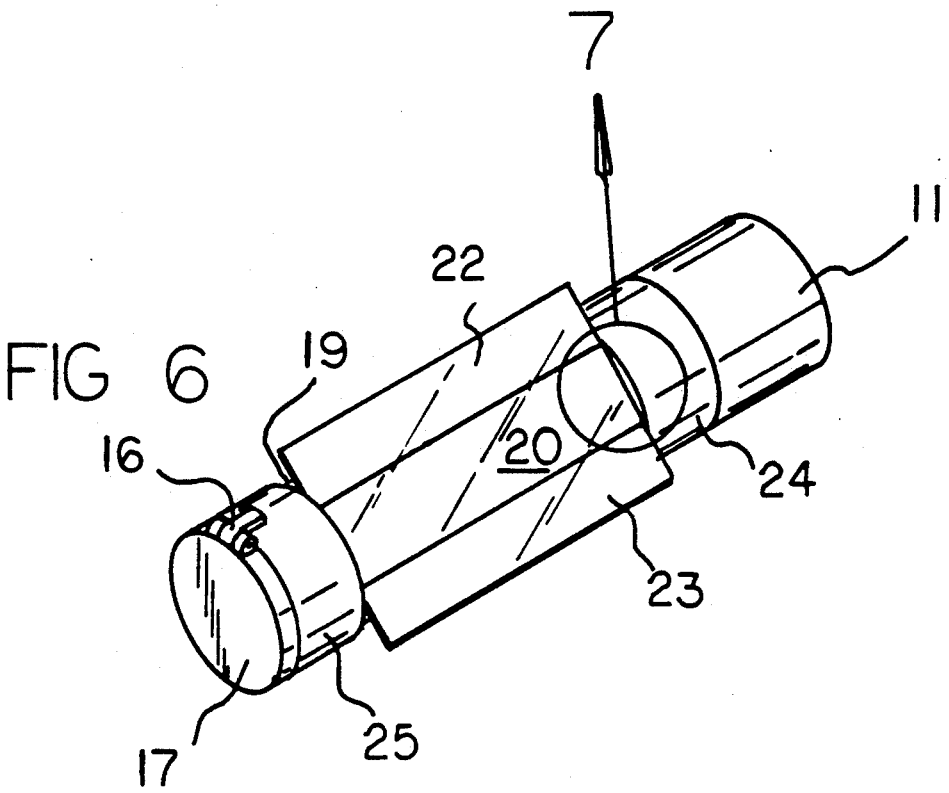
FIG. 6 is an isometric illustration of a further aspect of the invention.
Figure 7:
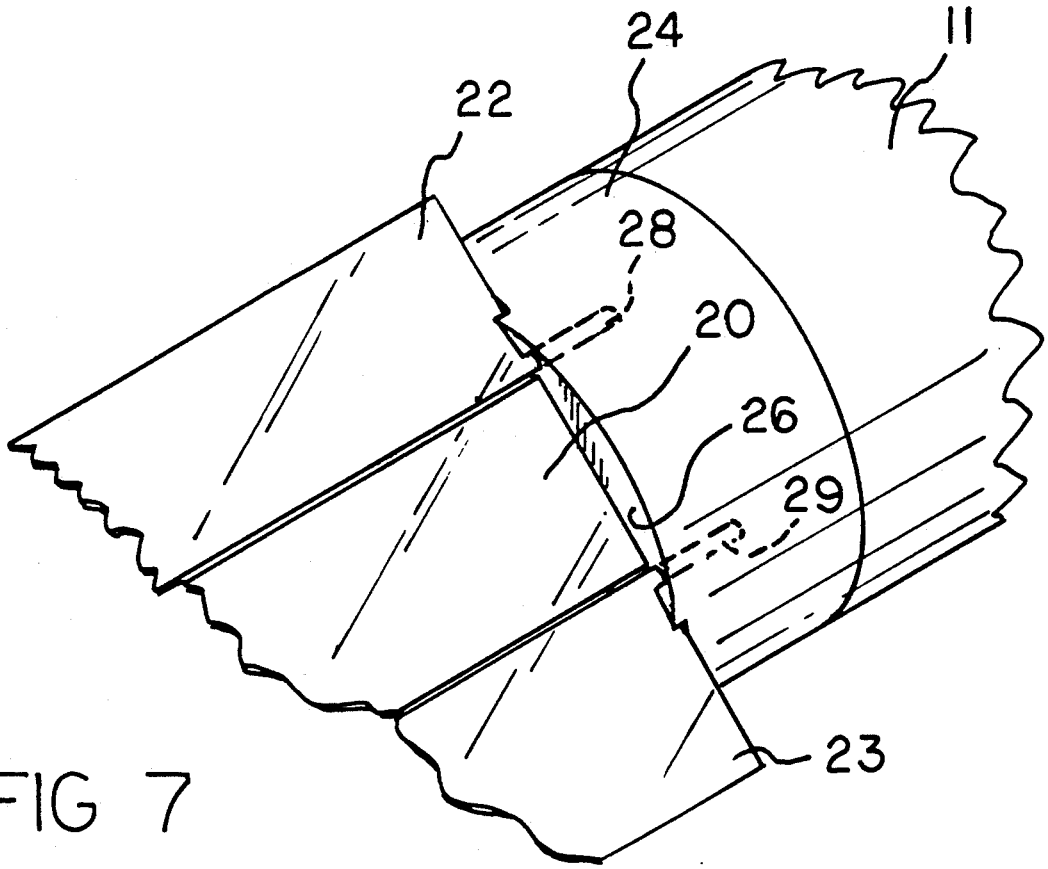
FIG. 7 is an isometric illustration of section 7, as set forth in FIG. 6

The FIGS. 6 and 7 illustrate the use of the cover tube 14 having respective cover tube first and second cylindrical body portions 24 and 25 on opposed ends of the polygonal body portion 19, wherein the first and second cylindrical body portions 24 and 25 are also coaxially aligned along the body axis 21. A first cylindrical body portion end wall 26 in confronting relationship to a second cylindrical body portion end wall 27 are formed at respective facing walls of the first and second cylindrical body portions 24 and 25 orthogonally oriented relative to the body axis 21. The second mirror plate includes a second mirror plate pivot axle 28, with the third mirror plate including a third plate pivot axle 29 directed orthogonally into the first cylindrical body portion end wall 26 to permit pivotment of the second and third mirror plates for coplanar alignment with the first mirror plate, in a manner as illustrated in the FIGS. 6 and 7.

The FIG. 8 illustrates the modified aspect of the invention as illustrated to include respective second mirror plate and third mirror plate spring hinges 31 and 32 (see FIG. 10) mounted between the respective second and third mirror plates 22 and 23 and the polygonal body portion 19. The second and third mirror plate spring hinges 3I and 32 bias the second and third mirror plates in a coplanar orientation relative to the first mirror plate, as indicated in FIG. 10. A slide ring 30 mounted between the first, second, and third mirror plates and the second cylindrical body portion 25 includes respective slide ring first and second pins 33 and 34 that are arranged for reception below the respective second and third mirror plates when the second and third mirror plates are in a coplanar relationship, as illustrated in FIG. 10, with the slide ring first and second pins 33 and 34 arranged for positioning over the second and third mirror plates when the second and third mirror plates are in a folded second position in contiguous communication with the polygonal body portion 19, as illustrated in FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mirrored lipstick container, comprising, a cylindrical base housing, the cylindrical base housing including a base housing extension tube, with a lipstick tube mounted within the extension tube, a cover tube removably mounted relative to the cylindrical base housing and the extension tube, with the cover tube coaxially aligned about a body axis, with the cover tube having a mirrored end wall, a spring hinge mounted to the cover tube adjacent the end wall, and a lid mounted to the spring hinge, with the lid biased in contiguous communication with the end wall in a first position and displaced relative to the end wall in a second position, the lid includes a convex mirrored surface for visual exaggeration, the cover tube includes a cover tube polygonal body portion coaxially aligned along the body axis, and the polygonal body portion including a first mirror plate arranged parallel to the body axis mounted to an exterior surface of the polygonal body portion, and the polygonal body portion includes a second mirror plate and a third mirror plate positioned on opposed sides of the first mirror plate.

2. A container as set forth in claim 1 wherein the cover tube includes a cover tube first cylindrical body portion and a cover tube second cylindrical body portion coaxially aligned along the body axis on opposed ends of the polygonal body portion, with the first mirror plate, the second mirror plate, and the third mirror plate positioned between the first cylindrical body portion and the second cylindrical body portion.

3. A container as set forth in claim 2 wherein the first cylindrical body portion includes a first cylindrical body portion end wall, the second cylindrical body portion includes a second cylindrical body portion end wall, wherein the first cylindrical body portion end wall and the second cylindrical body portion end wall are arranged in a confronting parallel relationship relative to one another, the second mirror plate includes a second mirror plate pivot axle, the third mirror plate includes a third mirror plate pivot axle, wherein the second mirror plate pivot axle and the third mirror plate pivot axle are arranged parallel relative to one another and directed into the first cylindrical body portion end wall pivotally mounting the second mirror plate and the third mirror plate relative to the first mirror plate to a first position, wherein the first mirror plate, the second mirror plate, and the third mirror plate are coplanar and permit displacement of the second mirror plate and third mirror plate to a second position, wherein the second mirror plate and the third mirror plate are arranged at an angular orientation relative to the first mirror plate.

4. A container as set forth in claim 3 including a slide ring mounted to the second cylindrical body portion, the slide ring having a slide ring first pin and a slide ring second pin arranged parallel relative to one another, and the second mirror plate includes a second mirror plate spring hinge mounted between the second mirror plate and the first mirror plate, and the third mirror plate includes a third mirror plate spring hinge mounted between the third mirror plate and the first mirror plate, wherein the first pin and the second pin are positioned below the second mirror plate and the third mirror plate in the first position and positioned above the second mirror plate and the third mirror plate in the second position.

* * * * *